US006081961A

United States Patent [19]

Wang

[11] Patent Number: 6,081,961

[45] Date of Patent: Jul. 4, 2000

[54] PORTABLE VACUUM CLEANER

[76] Inventor: Tian Wang Wang, No. 45, Yi Chang East Road, Taiping City, Taichung Hsien, Taiwan

[21] Appl. No.: 09/244,294

[22] Filed: Feb. 3, 1999

[51] Int. Cl.[7] ..... A47L 9/12; A47L 5/00

[52] U.S. Cl. ..... 15/327.2; 15/327.6; 15/347

[58] Field of Search ..... 15/327.1, 327.2, 15/327.6, 347, 353, 352

[56] References Cited

U.S. PATENT DOCUMENTS

| | | | |
|---|---|---|---|
| 2,818,596 | 1/1958 | Martinec | 15/327.2 |
| 3,177,635 | 4/1965 | Cawl et al. | 15/327.2 |
| 3,775,951 | 12/1973 | Eicholz et al. | 15/327.6 |
| 4,569,100 | 2/1986 | Purkapile | 15/327.6 |
| 4,654,926 | 4/1987 | McCambridge | 15/327.6 |
| 5,455,983 | 10/1995 | Crouser et al. | 15/353 |
| 5,564,155 | 10/1996 | Monesson | 15/327.1 |

*Primary Examiner*—Theresa T. Snider

[57] ABSTRACT

A vacuum cleaner includes a base and a cover secured together and a bellows type housing secured between the base and the cover. The cover includes a cylindrical wall and a hose connector extended through the cylindrical wall for connecting a flexible hose to the housing. A motor is secured on the cover, and a fan device is to the motor for drawing the dust into the housing. The vacuum cleaner includes a simplified structure having decreased weight and volume and includes a structure that may be easily folded to a compact configuration.

7 Claims, 4 Drawing Sheets

PORTABLE VACUUM CLEANER

BACKGROUND OF THE INVENTION

1. Field of the Invention

The present invention relates to a vacuum cleaner, and more particularly to a foldable vacuum cleaner.

2. Description of the Prior Art

Typical vacuum cleaners comprise a rigid and huge body occupying a large volume and having a large weight such that the vacuum cleaner may not be easily operated and manufactured and may not be folded.

The present invention has arisen to mitigate and/or obviate the afore-described disadvantages of the conventional vacuum cleaners.

SUMMARY OF THE INVENTION

The primary objective of the present invention is to provide a foldable vacuum cleaner having a greatly decreased weight and volume so as to facilitate the manufacturing and the operation thereof and having an easily foldable configuration.

In accordance with one aspect of the invention, there is provided a vacuum cleaner comprising a base, a hose, a cover being detachably securing to the base for forming a space between the cover and the base and including a hose connector connected to the hose, a housing received in the space and secured between the base and the cover for defining a chamber between the base and the cover. A fan device may draw the air and the dust into the chamber of the housing and may be filtered by a filter screen.

The cover detachably securing means includes at least two posts secured between the cover and the base for securing the cover and the base together. The cover includes a cylindrical wall and a casing for defining an annular groove therebetween, the annular groove is communicating with the chamber of the housing, the hose connector extends through the cylindrical wall for communicating the flexible hose with the annular groove of the cover.

The drawing means includes a motor secured on the cover, and a fan device received in the casing and secured to the motor for being driven by the motor and for drawing the air and the dust into the chamber of the housing. The filtering means includes a filter screen secured to the cylindrical wall for filtering the air and the dust and for retaining the dust in the chamber of the housing. The housing preferably includes a bellows type structure.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
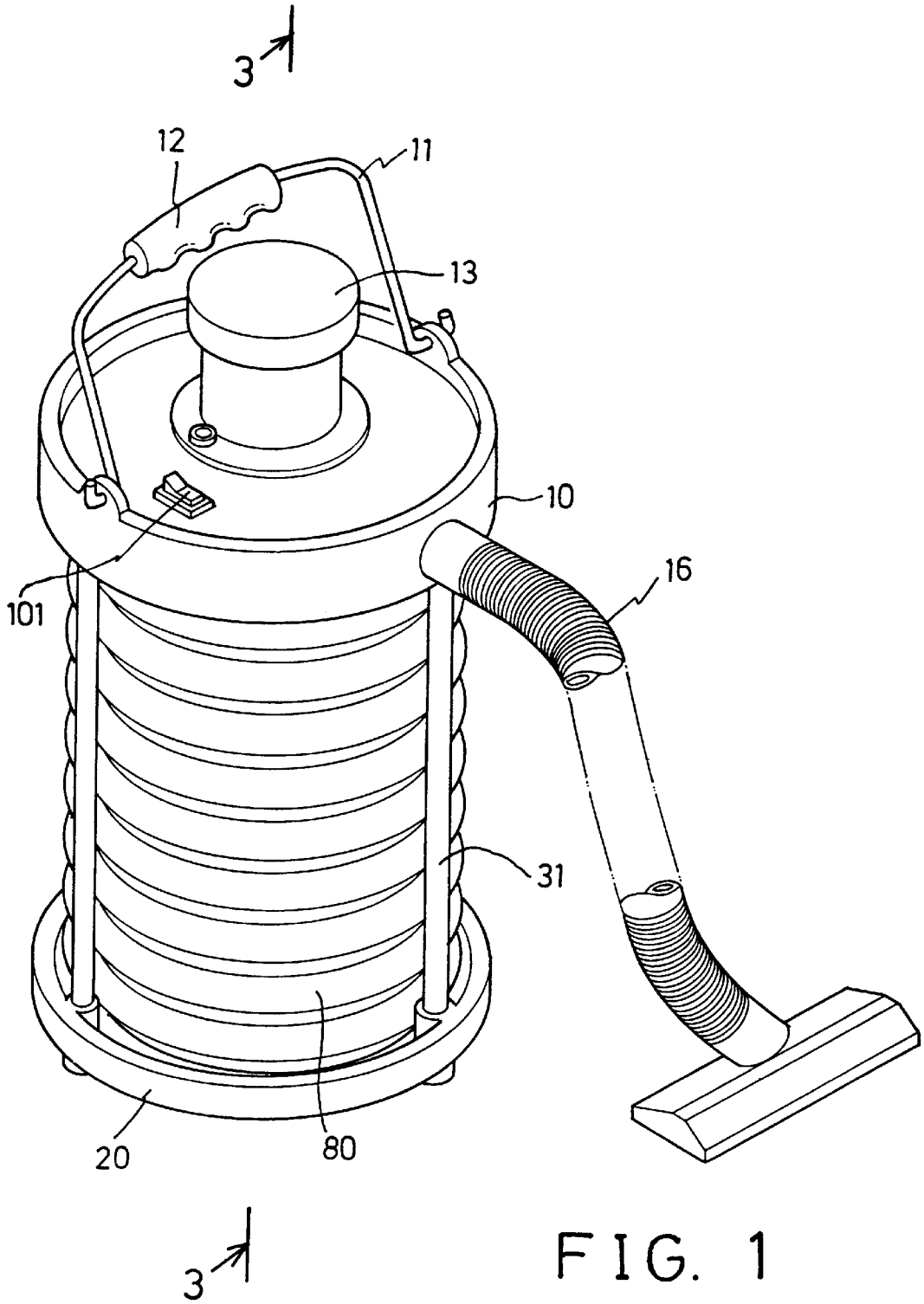
FIG. 1 is a perspective view of a foldable vacuum cleaner in accordance with the present invention.
Figure 2:
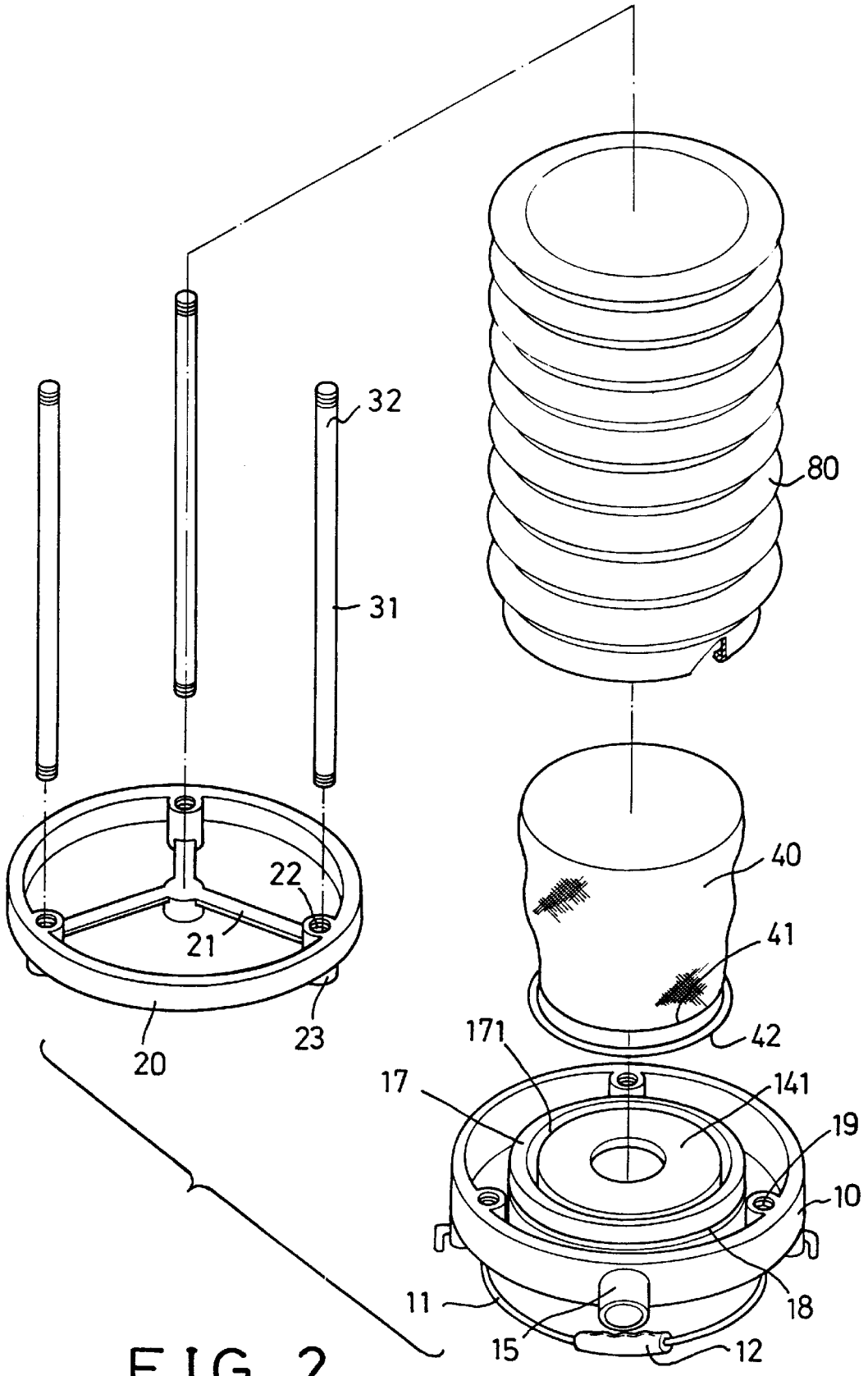
FIG. 2 is an exploded view of the vacuum cleaner.
Figure 3:
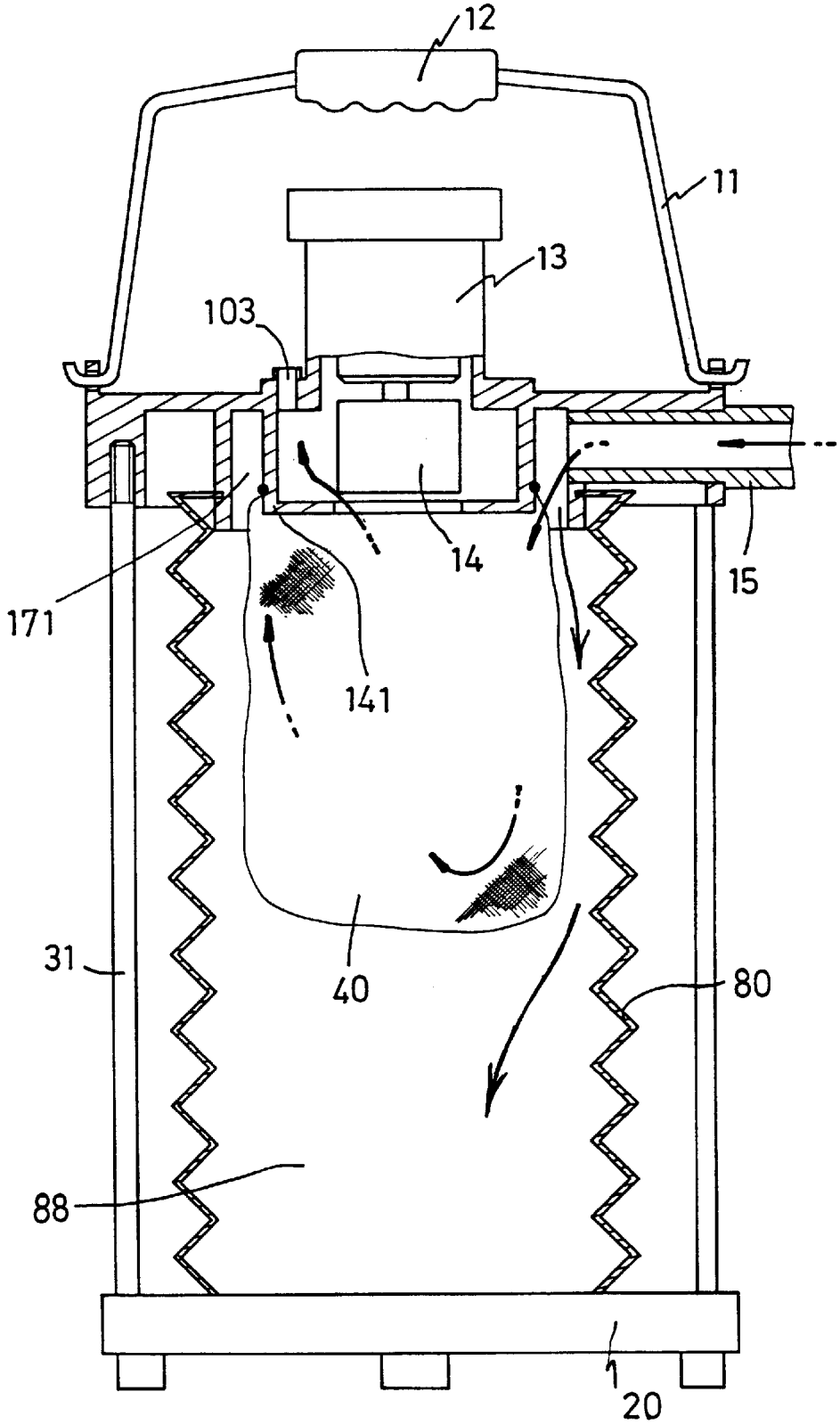
FIG. 3 is a cross sectional view of the foldable vacuum cleaner, taken along lines 3—3 of FIG. 1.

Referring to the drawings, and initially to FIGS. 1–3, a foldable vacuum cleaner in accordance with the present invention comprises a cover 10 which is shown up side down in FIG. 2. A handle 11 is secured to the cover 10 and has a hand grip 12 secured to the middle portion for carrying the vacuum cleaner. A motor 13 is secured on top of the cover 10 and a fan device 14 is secured to the motor 13 so as to be driven by the motor 13. A switch 101 is provided on top of the cover 10 for controlling the motor 13. The fan device 14 is engaged in and protected by a casing 141. The cover 10 includes a cylindrical wall 17 for defining an annular groove 171 between the cylindrical wall 17 and the casing 141. The cylindrical wall 17 includes an annular recess 18 formed in the outer peripheral surface. The cover 10 includes two or more screw holes 19 and includes a hose connector 15 extended through the cylindrical wall 17 for communicating a flexible hose 16 with the annular groove 171.

A base 20 includes a support 21 secured therein and includes two or more studs 23 each having a screw hole 22 formed therein. Two or more posts 31 each includes an outer thread 32 formed in the upper and lower end for threadedly engaging with the screw holes 19, 22 of the cover 10 and the base 20 respectively so as to secure the cover 10 and the base 20 together and so as to form a space between the cover 10 and the base 20. A dust bag or a filter screen 40 is disposed in the space defined between the cover 10 and the base 20 and includes an opening 41 for engaging with the cylindrical wall 17 of the cover 10 and is removably secured to the cylindrical wall 17 by a fastener member, such as a coil spring or a clamping ring 42. A bellows type housing 80 is disposed and secured between the cover 10 and the base 20 for forming a chamber 88 and for receiving the dust drawn into the housing 80.

In operation, the motor 13 may be selectively operated in order to actuate the fan device 14 when desired. When the motor 13 is actuated, the air and the dust may be drawn into the chamber 88 of the housing 80 via the flexible hose 16 and the hose connector 15 and the cylindrical groove 171 of the cover 10, and the air will be drawn out through the screen 40 and through an outlet 103 of the cover 10. The dust may thus be filtered and maintained in the chamber 88 of the housing 80.

Figure 4:
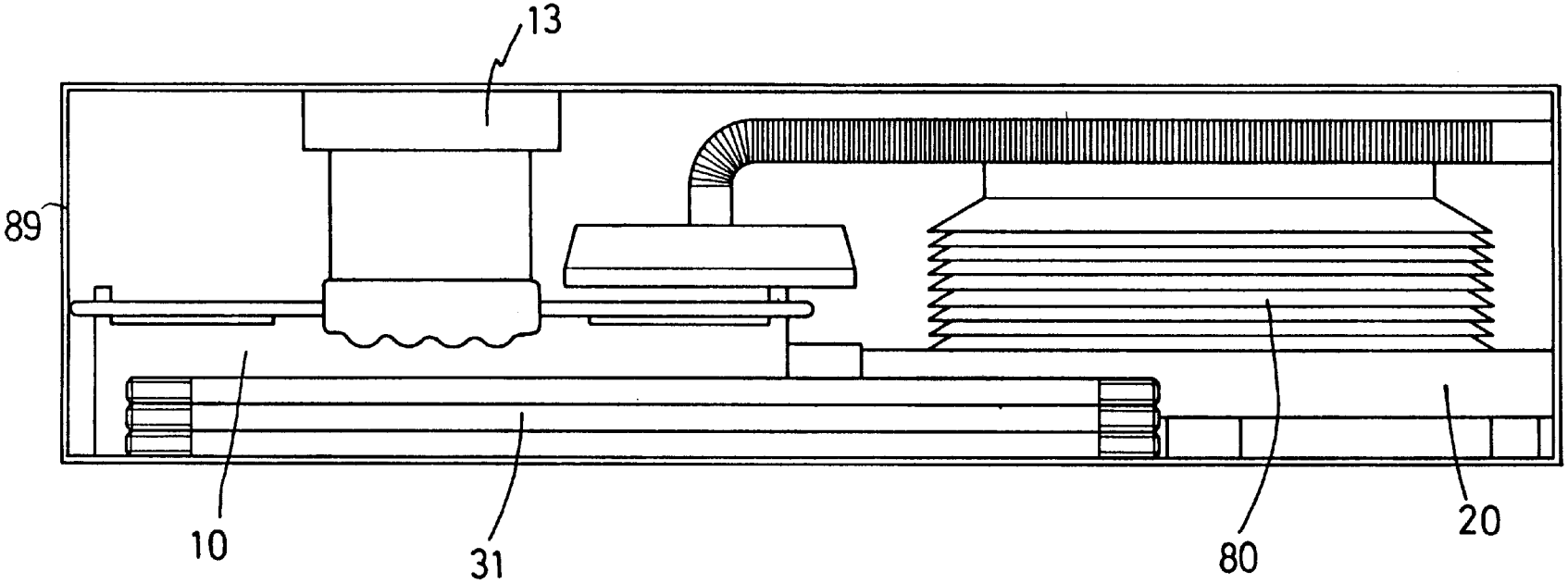
FIG. 4 is a schematic view illustrating the storing structure of the foldable vacuum cleaner.

Referring next to FIG. 4, the base 20 and the posts 31 and the bellows type housing 80 and the hose 16 may be easily disengaged from the cover 10 and stored in a package 89 for storing and transportation purposes. The bellows type housing 80 may be folded to a compact size.

It is preferable that three or more wheels are secured to the bottom of the base 20 for allowing the vacuum cleaner to be moved easily.

Accordingly, the foldable vacuum cleaner in accordance with the present invention includes a greatly simplified configuration having a greatly decreased weight and volume so as to facilitate the manufacturing and the operation thereof. The foldable vacuum cleaner thus includes a structure that may be folded to a compact configuration for facilitating the storing and the transportation effects thereof.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A vacuum cleaner comprising:

a base, a hose, a cover including a hose connector connected to said hose, means for detachably securing said cover to said base, a space being formed between said cover and said base when said cover is secured to said base, said cover detachably securing means including at least two posts having a first end secured to said cover and having a second end secured to said base for securing said cover and said base together, a housing received in said space and secured between said base and said cover for defining a chamber between said base and said cover, means for drawing air and dust through said hose and said hose connector and into said chamber of said housing, and means for filtering the air and the dust and to retain the dust in said chamber of said housing.

2. A vacuum cleaner according to claim 1, wherein said cover includes at least two screw holes formed therein, said base includes at least two studs each having a screw hole formed therein, said at least two posts each includes two ends each of which having an outer thread provided therein for engaging with said screw holes of said studs and for securing said cover and said base together.

3. A vacuum cleaner according to claim 1, wherein said cover includes a cylindrical wall and a casing for defining an annular groove therebetween, said annular groove is communicating with said chamber of said housing, said hose connector extends through said cylindrical wall for communicating said hose with said annular groove of said cover.

4. A vacuum cleaner according to claim 3, wherein said drawing means includes a motor secured on said cover, and a fan device received in said casing and secured to said motor for being driven by said motor and for drawing the air and the dust into said chamber of said housing.

5. A vacuum cleaner according to claim 3, wherein said filtering means includes a filter screen secured to said cylindrical wall for filtering the air and the dust and for retaining the dust in said chamber of said housing.

6. A vacuum cleaner according to claim 1, wherein said housing includes a bellows type structure.

7. A vacuum cleaner comprising:

a base, a hose, a cover including a hose connector connected to said hose, said cover including a cylindrical wall and a casing for defining an annular groove therebetween, said hose connector extending through said cylindrical wall for communicating said hose with said annular groove of said cover, means for detachably securing said cover to said base, a space being formed between said cover and said base when said cover is secured to said base, a housing received in said space and secured between said base and said cover for defining a chamber between said base and said cover, said annular groove of said cover communicating with said chamber of said housing, means for drawing air and dust through said hose and said hose connector and into said chamber of said housing, and means for filtering the air and the dust and to retain the dust in said chamber of said housing, said filtering means including a filter screen secured to said cylindrical wall for filtering the air and the dust and for retaining the dust in said chamber of said housing.

* * * * *